US006523828B2

(12) United States Patent
Lorenzin

(10) Patent No.: US 6,523,828 B2
(45) Date of Patent: Feb. 25, 2003

(54) GAME OF CHANCE AND SKILL, METHOD OF PLAY, GAME COMPONENTS, AND GAME BOARD

(76) Inventor: Serge Lorenzin, Edif, Amalia 2DO. Piso of. No. 4, San Jose (CO)

( * ) Notice: Subject to any disclaimer, the term of this patent is extended or adjusted under 35 U.S.C. 154(b) by 0 days.

(21) Appl. No.: 09/976,353

(22) Filed: Oct. 12, 2001

(65) Prior Publication Data

US 2002/0043763 A1 Apr. 18, 2002

Related U.S. Application Data

(60) Provisional application No. 60/240,134, filed on Oct. 13, 2000.

(51) Int. Cl.[7] ..... A63F 3/00
(52) U.S. Cl. ..... 273/274; 273/146; 273/309
(58) Field of Search ..... 273/274, 146, 273/309

(56) References Cited

U.S. PATENT DOCUMENTS 4,299,392 A * 11/1981 Tammen
4,346,900 A * 8/1982 Lamlee
4,635,938 A * 1/1987 Gray
4,927,147 A * 5/1990 Delzio
5,350,175 A * 9/1994 DiLullo et al.
5,806,847 A * 9/1998 White et al.
6,179,489 B1 * 1/2001 Astaneha
6,217,022 B1 * 4/2001 Astaneha

* cited by examiner

*Primary Examiner*—William M. Pierce

(57) ABSTRACT

Random-chance gaming components and a game table arrangement provide for games of skill, free from complicated rules, enabling unexperienced newcomers to participate. Participants do not play against each other, and individual wagers can be made uniform in amount. Each participant can, in sequence, have an opportunity to "toss" a pair of six-sided game components which are coded by number and by color. Return odds on particular combinations are presented on the game table; individual selection(s) for wagering are made by participants before a "toss". A third game component provides possible percentage reduction(s) in the amount of return on a wager; such an arrangement can be used to pay for commercially run games; or, can be used for games run to help support a volunteer organization, or can help to establish funds when an individual "banker" is selected from among the participants in a residence, using game board arrangement as a table cover.

7 Claims, 5 Drawing Sheets

GAME OF CHANCE AND SKILL, METHOD OF PLAY, GAME COMPONENTS, AND GAME BOARD

RELATED APPLICATION

This application claims the priority of U.S. Provisional Patent Application Serial No. 60/240,134, filed Oct. 13, 2000.

INTRODUCTION

This invention is concerned with entertainment involving the exercise of intellectual choice and, in particular, a game with new random-chance gaming components and a new game board surface arrangement for play of the game.

OBJECTS OF THE INVENTION

An important object is to combine entertainment with skill at estimating probabilities and chance results, so as to provide the atmosphere of a casino without the complexities of prior casino games.

A related object is a game for a new type of gaming establishment which is attracting newcomers seeking entertainment without complicated rules and without undue financial risk.

A further object is to provide ease of game supervision and related gaming functions.

Another object is to provide new gaming components and a new gaming surface which inexperienced newcomers can readily understand.

The above and other objects, features and advantages of the invention are described in more detail with reference to the accompanying drawings.

DETAILED DESCRIPTION OF THE INVENTION

Games, such as craps, played in large casinos are complex, very fast moving, and can be costly in time and money before a newcomer can begin to adequately learn how to play.

A roulette table in large casinos can also be foreboding, with all play being against the "house" and with the outcome of some random events reserved strictly for the house; that is, in which all customer participants lose.

Whereas the gaming components, rules of play and play surface of the present invention enable easily-adapted play, provide for one, or a comfortable number of participants, can minimize, or eliminate, house participation in game playing aspects, and can be readily used in a private home or private club.

Figure 1:
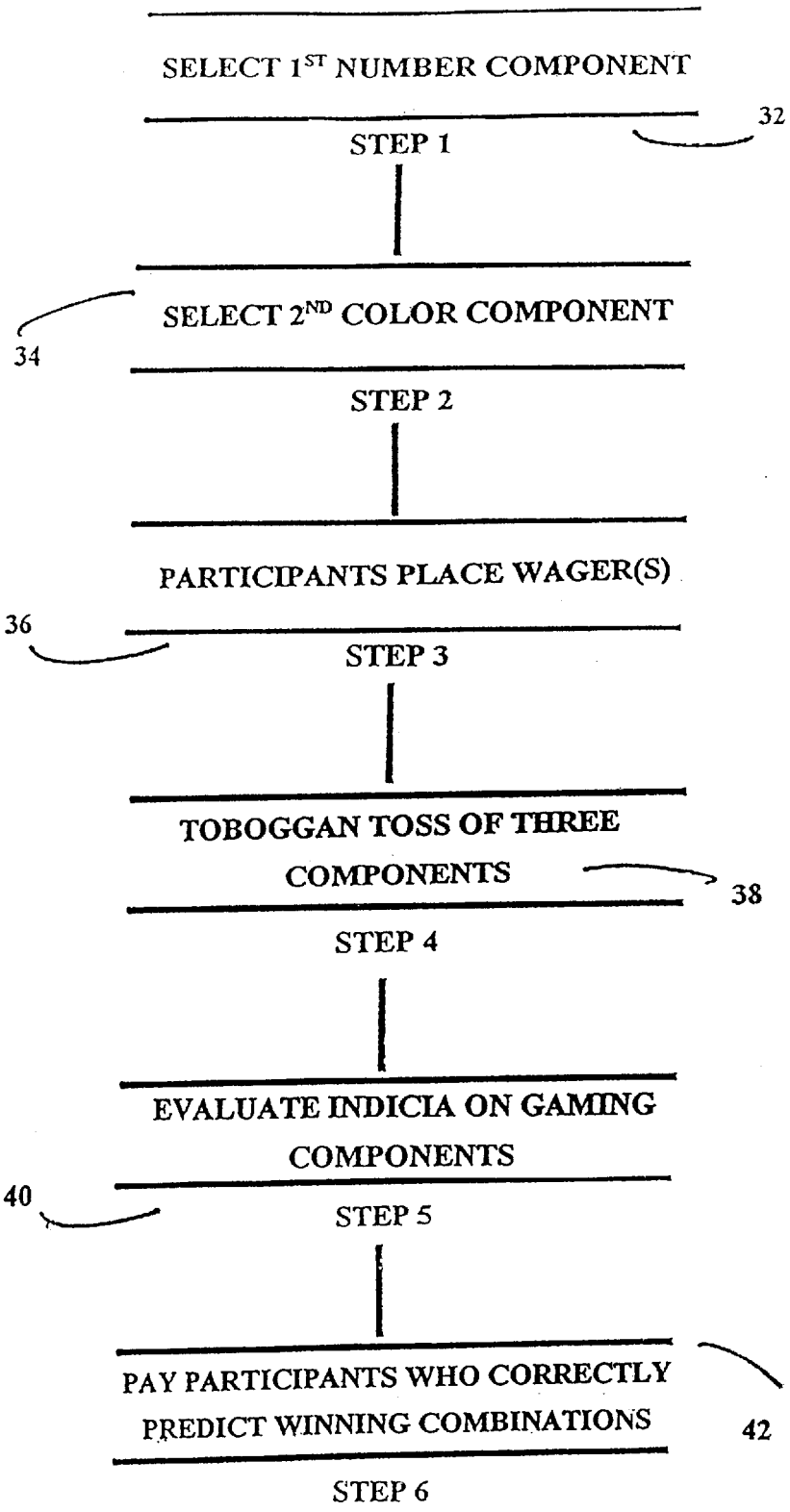
FIG. 1 is a schematic flow chart for describing method of play for a specific embodiment of the invention.
Figure 2:
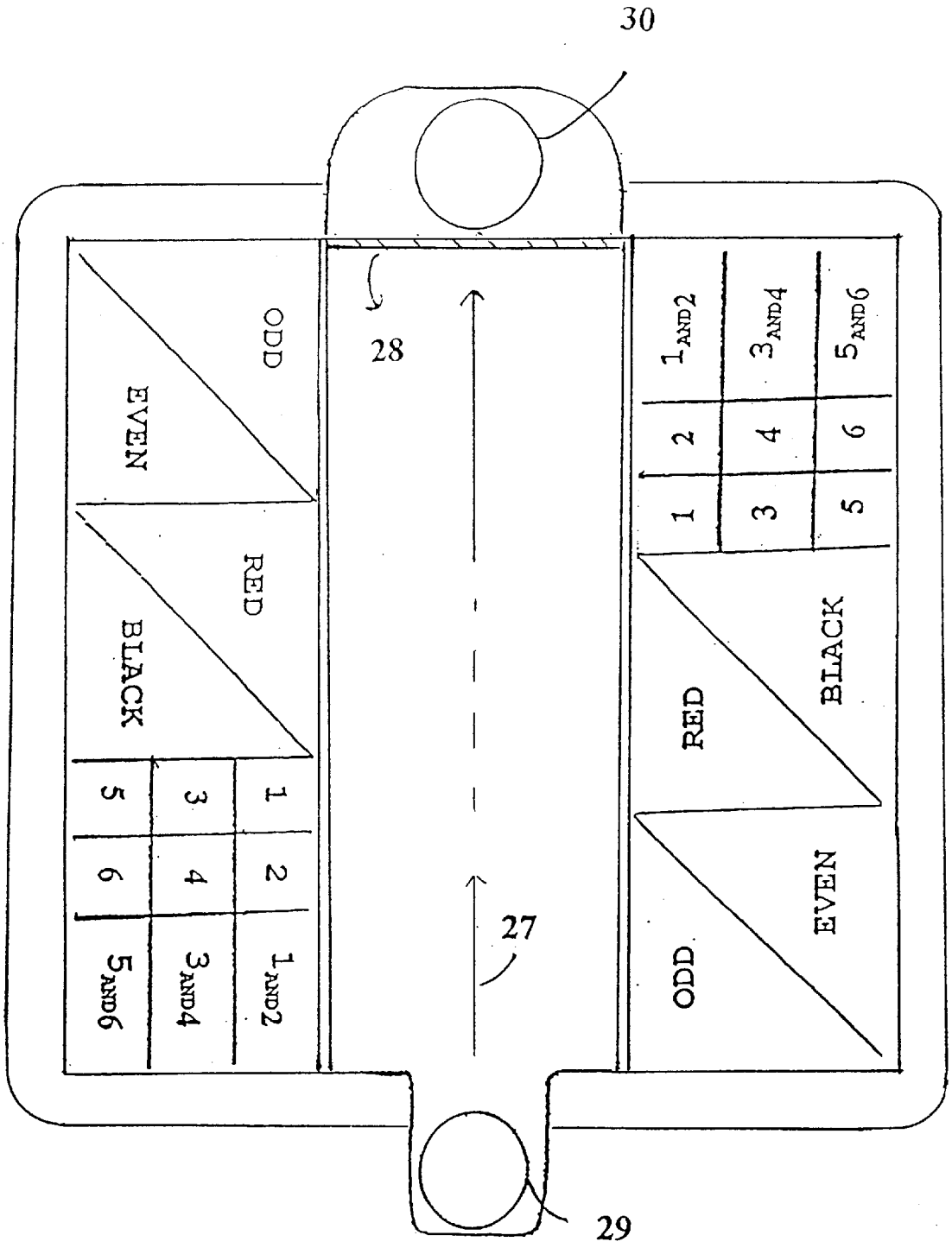
FIG. 2 is a plan view of a game surface of the invention for implementing the game with multiple participants.
Figure 3:
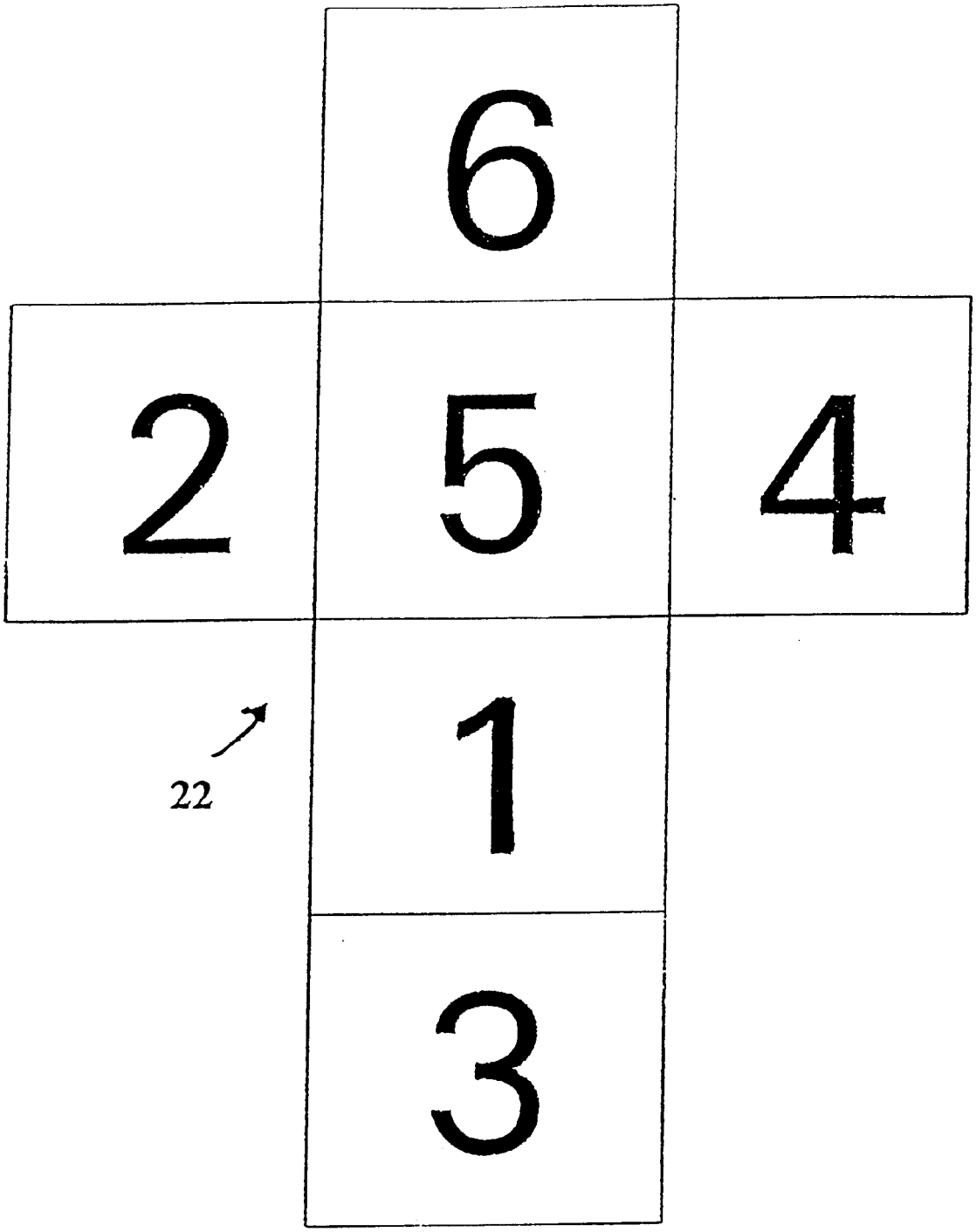
FIG. 3 is a planar presentation of a first six-sided cubic-configuration gaming component of the invention.

For purposes of describing the invention:

FIG. 1 is a flow chart representation of play of the game; FIG. 2 presents game board surface cover 20, for carrying out the method of FIG. 1, and enabling placing of wagers by participants on such game board; FIG. 3 presents a planar view of a first gaming component 22, and FIG. 4 presents a planar view of a second gaming component 24; third cubic-configuration gaming component 26 of FIG. 5 will be considered separately.

Each cubic-configuration gaming component has six substantially square, equal-area external surfaces. Each surface of the first gaming component 22 has a distinct numeric value, with half the numbers being even and half being odd. To help to readily distinguish the three gaming components during play, an overall background color for cube 22 is selected, for example, as blue.

The second gaming component, cube 24, has three surfaces which are black, and three surfaces which are red. That is, half of the six surfaces should present one color, with the remaining half presenting a second color differing from that of the first half of the surfaces. Other colors can be used, but color selection requires careful consideration in order to facilitate distinguishing the three gaming components during play of the game; for example, the blue background color of the first gaming component 22 should be avoided in other components.

Figure 4:
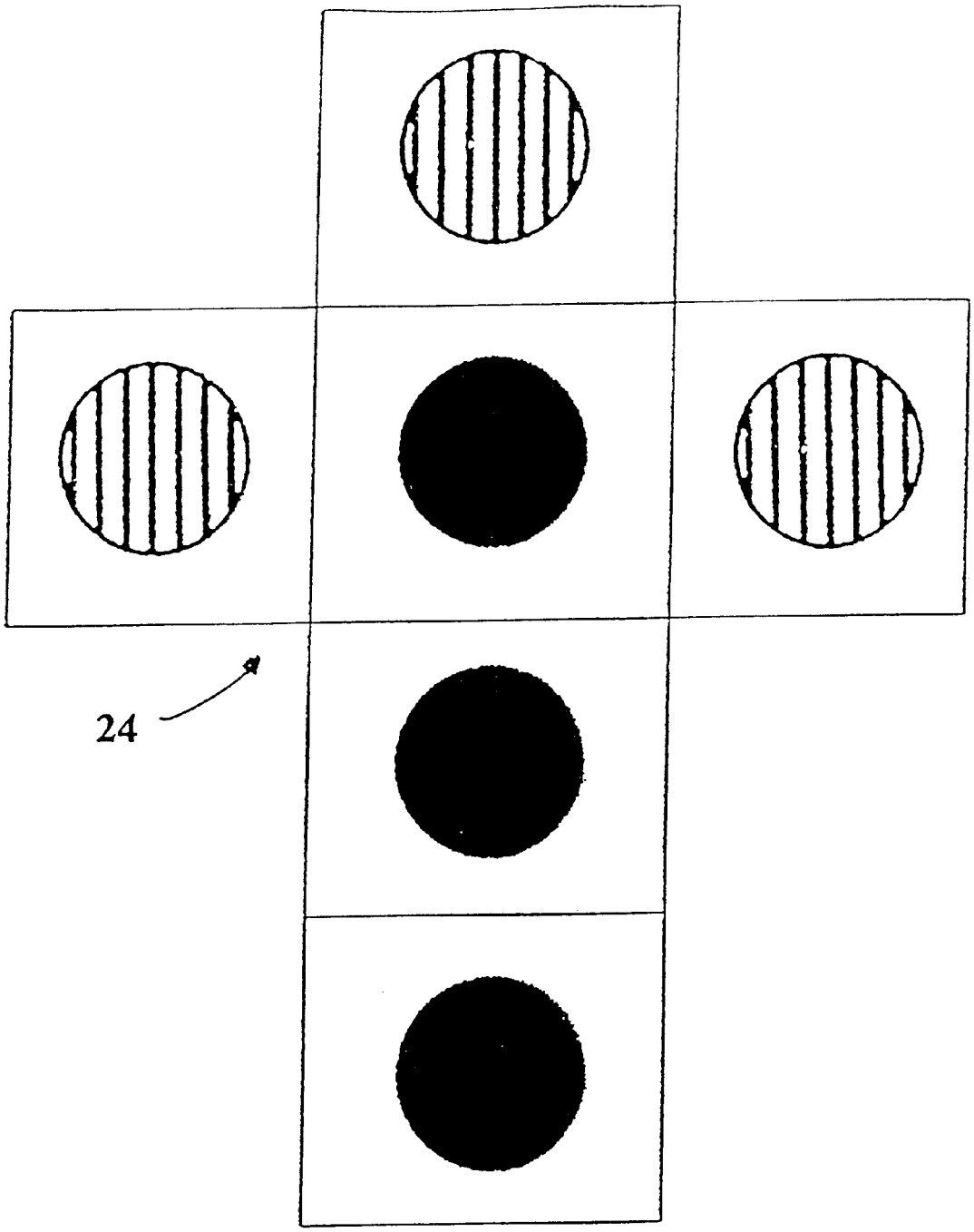
FIG. 4 is a planar presentation of a second six-sided cubic-configuration gaming component of the invention which is played in combination with the component of FIG. 3.

The first cubic gaming component, 22 of FIG. 3, and second cubic gaming component, 24 of FIG. 4, provide the basis for estimating possible winning selections by participants.

Figure 5:
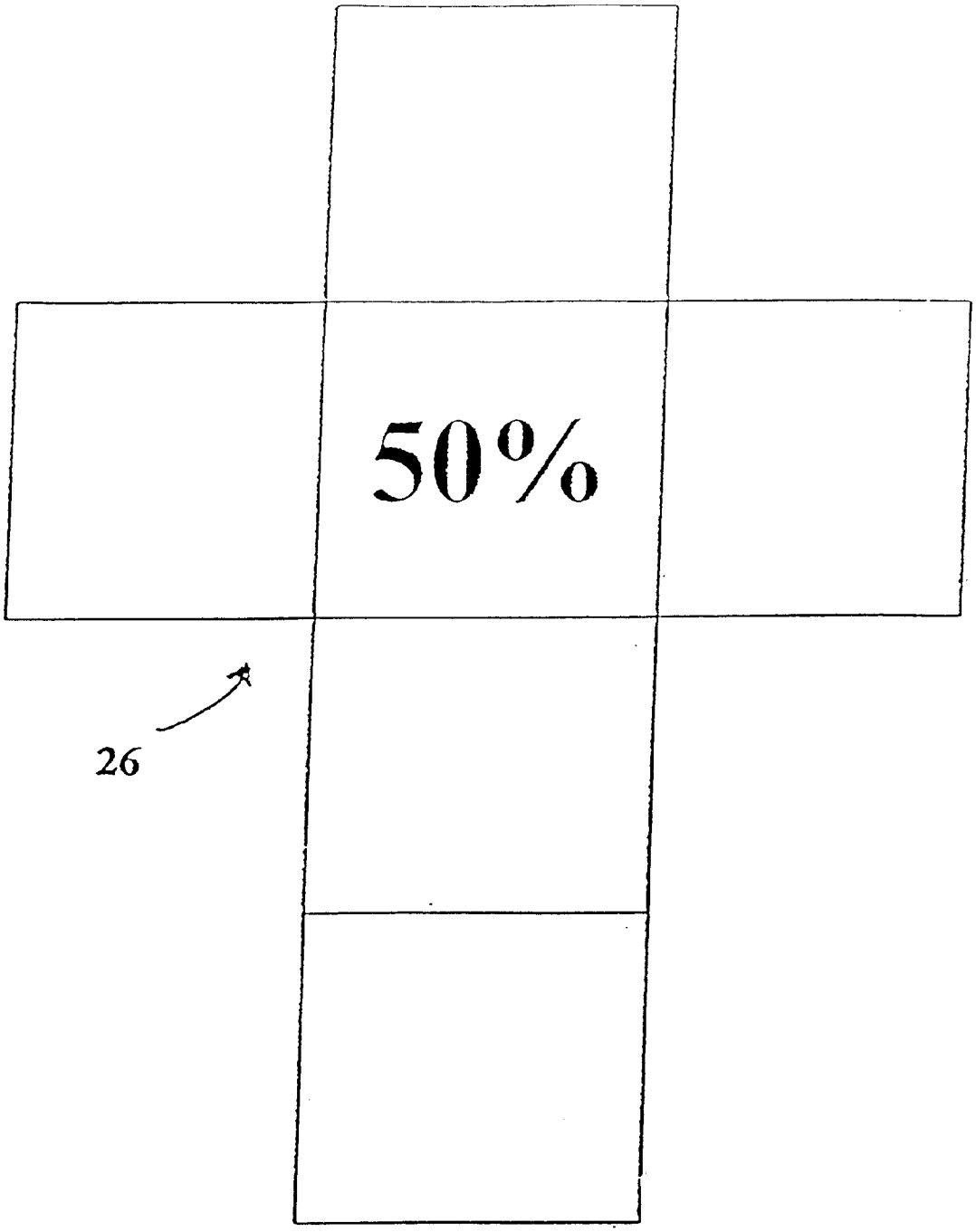
FIG. 5 is a planar presentation of a third six-sided cubic-configuration gaming component of the invention, played with the components of FIGS. 3 and 4, for enhancing chance results of the game.

However, the third cubic gaming component, 26 of FIG. 5, is not selected by participants; cube 26 can modify payout results, as will be disclosed after describing play of the game.

In play of the game, all three gaming component are tossed into play using a holder referred to as a "toboggan" (not shown); the toboggan has an open sleeve-like structure which holds the three gaming components, free of hand contact by the active (component-tossing) player. The direction for tossing the gaming components at start of the game is shown by arrow 27 in FIG. 2.

The goal for a participant is to successfully predict the outcome of the first two gaming components before play is started. A participant can win by estimating, before the start of the game, random occurrences that will be achieved after the simultaneously cast cubic-configuration gaming components come to rest. The gaming components are tossed in the direction 27 to come into contact with component-contact backboard 28 of FIG. 2 before coming to rest.

The playing surface (or game board) includes an elongated toss path, as indicated by the extension of arrow 27, which extends to contact board 28 (FIG. 2). The topography of the toss path places it at a lower position vertically than the wagering stations along each side of that path. The active player, for tossing the components, is located at 29, at one longitudinal end of that path; and the game "controller" is located at 30, at the opposite longitudinal end of that path.

After the cubic-configuration gaming components come to rest, the number on the upside of numeric cube 22, and the color on the upside of the second cubic component 24 provide the basis for determining a winner.

For example:

(A) the likelihood of a selected number on the upside of the six-sided cube of numeric component 22, combined with correctly selecting the upside color of gaming component 24, provides a probability which results in a payout of twelve-to-one; that is:

(i) a one-in-six probability on the numeric component 22 is multiplied (ii) by the one-in-two probability of the color component 24, to provide (iii) the twelve-to-one odds;

(B) the upside number of numeric gaming component 22, regardless of whether a color is chosen for color component 24, provides a one-in-six chance of selecting the correct number; and, free of any selection for color component 24, will provide for odds of six-to-one, if properly selected before start of the game;

(C) selecting a color for gaming component 24 (regardless of whether a number is chosen for the first gaming component 24) provides a one-in-two probability of picking the correct upside color of the two colors (red and black), and the payout is based on odds of two-to-one;

(D) whether the number of the first numeric gaming component 22 is odd or even (regardless of whether a color is chosen for second gaming component 24) provides a payout based on the probability (one-in-two) of choosing correctly;

(E) selecting whether the upside number of numeric component 22 will be odd or even and, also, choosing the upside color of the second gaming component 24, combines a two-to-one probability with an added two-to-one probability; a payout would be based on those combined probabilities; that is, four-to-one; and (F) another winning selection, from the specific embodiment game board surface cover of FIG. 2, is based on the probability of an upside surface of the first gaming component 22 displaying a selected number out of three sets of consecutive numbers, such as "1 and 2"; "3 and 4"; or "5 and 6." Selecting the correct upside number on cube 22, by choosing to play one of those sets, provides a probability of one-in-three; and the payout is based on three-to-one odds.

If an upside color were correctly selected for cube 24 in addition to choosing the correct number by means of a set, the combined odds are multiplied (three times two) to provide a payout based on odds of six-to-one.

The third gaming component 26 of FIG. 5, and its possible effect on payout, will be considered after further description of play of the game based on the first and second gaming components 22, 24. A non-conflicting color, such as purple, is selected for component 26.

Referring to FIG. 1, the initial two steps (32, 34) refer to participant selections, generally privately analyzed without communication, before start of the game. The combinations, as described above, are taken into consideration. Then, an individual participant, including an active player selected for tossing the components, places a wager at the step designated 36 of FIG. 1.

When wagering around the table is complete, the controller, located at station 30 of FIG. 2 (who also generally acts as banker), signals for step 38 (FIG. 1); that is, simultaneously tossing all three gaming components.

Referring to FIG. 2, the toss is carried out by means of a "toboggan" in the direction indicted by arrow 27 for "banking" contact with backing board 28.

When the toss is complete; that is, the three gaming components have come to rest after banking off of backboard 28, the next step, 40 of FIG. 1, "Evaluating Indicia on Gaming Components" is carried out.

A house banker/controller generally does not compete in the game against any of the participants; there may be an exception if the game were being played in a private club or home. The banker/controller provides (a) the three cubic gaming components, (b) identifies participants at the table and their respective wagers, (c) controls the order of play of the game, (d) collects non-winning wagers, and (e) makes payments to winners.

Among the advantages of the invention are the simplicity of play for a newcomer, the ease of administration of the game by a banker/controller, and the entertainment generated during play of the game.

Although the game is designed to enable play among friends in a private home or club, a banker/controller functioning for a gaming establishment is preferred for control of the game. Advantages are that more rounds of play can often be completed in a fixed time, and participants (generally about seven) are free of responsibility for flow of the game, thus enabling greater concentration on the probabilities of an outcome.

Each participant in the game has the chance to be an "active player"; that is, to throw the cubic-configuration gaming components. A fixed amount wager for each of one or more bets by one or more participants must be properly in place on the playing surface before simultaneously tossing the three gaming components for start of each game.

Each participant can make one or more equal wagers for his or her bet(s). The players are not playing against each other, and the dollar amount for each wager is fixed in advance, which provides for uniformity in calculating payouts. Each participant is testing his or her own skill at estimating probabilities and selecting winners as described above.

If a participant has correctly picked any of those winning selections or combinations, the participant is in a position to receive payment according to the probabilities for achieving such a result. As set forth above, each participant is making a selection or selections based on the first (numeric) and second (color) components of the three cubic components to be tossed.

In the embodiment of FIG. 5, five of the six sides of gaming component 26 are blank, and the sixth presents a percentage. Any one of those five blank sides becoming the upside of the third component 26, after completion of the toss, eliminates any modification of the payout due, based on selected upsides of components 22, 24.

However, in the specific embodiment, the sixth side of the third component 26 is marked 50%. If that 50% designation occurs as the upside, after completion of the toss, each payout is decreased by one half to each winner. That occurrence also signals a change in the tossing participant (the active player).

A "round" with the same active player tossing the game components continues until the third component 26, of the specific embodiment, indicates a modification of the payout; then, the next designated participant will take his or her turn at tossing the three gaming components to start the first game of a new round.

The game can be played in a similar fashion with the banker/controller dispensing the three components onto the playing table using a chute, or so-called toboggan; however, individual player participation by tossing the components is preferred.

Other selections for the surfaces of the third cubic component (26, FIG. 5) can be utilized. For example, in another embodiment, the game can be played with the third gaming component (26) presenting two or three blank surfaces, provided such a change is made known in advance to each participant in a gaming establishment or in a private club or home game.

For example, instead of having a single surface with a percentage which decreases the payout for winning combinations by one half, more than one of the six surfaces can decrease payout for winning combinations. For example, the six sides could be 150%, 25%, 25%, blank, blank, blank. That arrangement provides a single chance for a significant increase in payout with a single occurrence based on the third component. Also, that arrangement provides a probability for more frequent rotation of active "tossing" players. However, the number of decreased payouts would be greater. A fixed fee for a gaming establishment would take into consideration such changes due to the third component.

A preferred game table design is described in relation to FIG. 2. In such a table, adequate spacing for "tossing" three cubic game components simultaneously is provided and, also, locations for placing wagers by a selected number of participants, such as three or four, along each side of an elongated tossing space.

While specific colors and arrangements for numeric, color, and payout modification gaming components have been described to facilitate an understanding of the invention, it should be recognized that changes in any of those specifics can be made without departing from the principles of the invention taught herein. Therefore, for purposes of determining the scope of the invention, reference shall be made to the accompanying claims.

What is claimed is:

1. Apparatus for playing a game involving exercise of intellectual skill in estimating probability and which results, comprising (I) three distinct gaming components of cubic configuration, with each gaming component presenting six substantially-square equal-area external surfaces, including (A) a first cubic-configuration gaming component in which each said external surface presents a single distinct number of increasing consecutive value so as to provide three pair of consecutive numbers, (B) a second cubic-configuration gaming component, which is free of a numerical value indication, presenting multiple colors, with (i) three of said six external surfaces of the second cubic-configuration gaming component presenting the same color, and (ii) the three remaining external surfaces of the second cubic-configuration gaming component presenting a differing color which is identical on each of such three remaining surfaces, and (C) a third cubic-configuration gaming component for determining a possible modification in a payout from a winning wager by a player, in which wagers are selected by a player solely from the group consisting of:

(i) a wager based on said first gaming component, (ii) a wager based on said second gaming component, and (iii) a wager based on combining said first and second gaming components;

(a) with said six substantially-square external surfaces of said third gaming component being free of selection by a player, and, including (b) at least one surface presenting a payout modification indicia for a selected winning wager; and (II) a gaming surface with locations enabling a player to select a wager from the group of (i), (ii), and (iii) as set forth above.

2. The invention of claim 1 in which said gaming surface locations enable a wager selection based on the group consisting of:

(i) a combination of three odd numbers from said first gaming component, (ii) a combination of the three even numbers from said first gaming component, (iii) a single number from said first gaming component, (iv) a pair of consecutive numbers from said first gaming component, (v) a single color choice of said second gaming component, and (vi) a combination of (i) to (v).

3. The invention of claim 2, in which said first cubic-configuration gaming component presents said single distinct number on each of said six external surfaces having a numerical value of one (1) through six (6); and said second cubic-configuration gaming component, presents (i) three of said six external surfaces with the color red, and (ii) three remaining of said six external surfaces with the color black.

4. The invention of claim 2, in which said payout modification indicia on such third gaming component consists of at least one surface of said six external surfaces presenting a percentage value of less than one hundred percent.

5. The invention of claim 2, in which said payout modification indicia on said third gaming component consists of at least one surface of said six external surfaces presenting a percentage value greater than one hundred percent.

6. A method of playing a game involving exercise of intellectual skill at estimating probabilities and chance results, comprising (II) establishing three distinct gaming components of cubic configuration, each said component presenting six substantially-square equal-area external surfaces, by (A) providing a first cubic-configuration gaming component with a single distinct number of increasing consecutive value on each of its six external surfaces, making available three pair of consecutive numbers;

(B) providing a second cubic-configuration gaming component having external surfaces distinguishable by color, with (i) three of said six second gaming component external surfaces presenting a single color, and (ii) the three remaining surfaces of such second gaming component presenting a single color differing from said previously designated single color;

(C) providing a third cubic-configuration gaming component, with a indicia for modifying a possible payout to a player on a wager, which is selected solely from the group consisting of (i) said first gaming component, (ii) said second gaming component, and (iii) a combination of (i) and (ii);

(III) providing a wagering surface for a player to establish a wager, before start of play, based on estimating a winning outcome by selecting from the group consisting of (i) combining odd numbers of said first gaming component, at odds of 3 to 1, (ii) combining even numbers of said first gaming component, at odds of 3 to 1, (iii) a single number from said first gaming component, at odds of 6 to 1, (iv) a pair of consecutive numbers from said first gaming component, at odds of 3 to 1, (v) a single color from said second gaming component, at odds of 2 to 1, and (vi) a combination selected from (i) to (v); then after selecting from wagers available to players solely on said first and second components;

(IV) arranging for simultaneous casting of said first, second, and third cubic-configuration gaming components, which casting is completed by revealing one upside external surface for each of said three gaming components;

(V) evaluating an initial wagering outcome as determined from each upside external surface of said first and second gaming components, and (VI) determining whether said initial wagering outcome is modified by said upside external surface of said third gaming component, for purposes of making a winning payout to an individual player.

7. A gaming layout for a game involving exercise of intellectual skill in estimating probabilities and chance results, which provides (I) a location for viewing results of casting three distinct gaming components of cubic configuration, each said gaming component presenting six substantially-square equal-area external surfaces, including (A) a first cubic-configuration gaming component with each said surface presenting a single distinct number of increasing consecutive value, so as to provide three pairs of consecutive numbers;

(B) a second cubic-configuration gaming component, which is free of a numerical value indication, presenting multiple colors, with (i) three of said six external surfaces of the second cubic-configuration gaming component presenting the same color, and (ii) the three remaining external surfaces of the second cubic-configuration gaming component presenting a differing color which is identical on each of said three remaining surfaces; and (C) a third cubic-configuration gaming component with a surface for a possible modification of a payout from a selected winning wager location;

(II) locations for wagering by a player, including (i) at least one location for each of said colors on said second gaming component, and (ii) numerical value locations based on said external surfaces of said first gaming component, including at least:

(a) six single numerical value locations, (b) a location combining odd numbers for half of said six numerical values, (c) a location combining even numbers for half of said six consecutive numerical values, and (d) a location for each of said three pairs of consecutive numerical values from said six numerical values.

* * * * *